US009622530B2

(12) United States Patent
DiCarlo

(10) Patent No.: US 9,622,530 B2
(45) Date of Patent: Apr. 18, 2017

(54) OPTICAL DEVICE MOUNTING ADAPTER

(71) Applicant: Joseph A. DiCarlo, Chester, NH (US)

(72) Inventor: Joseph A. DiCarlo, Chester, NH (US)

(73) Assignee: Robert J. McCreight, Jr., San Antonio, TX (US)

( * ) Notice: Subject to any disclaimer, the term of this patent is extended or adjusted under 35 U.S.C. 154(b) by 507 days.

(21) Appl. No.: 14/184,818

(22) Filed: Feb. 20, 2014

(65) Prior Publication Data

US 2014/0237708 A1 Aug. 28, 2014

Related U.S. Application Data

(60) Provisional application No. 61/768,759, filed on Feb. 25, 2013.

(51) Int. Cl.
*A42B 3/04* (2006.01)

(52) U.S. Cl.
CPC ..... *A42B 3/042* (2013.01); *A42B 3/04* (2013.01)

(58) Field of Classification Search
CPC ..... A42B 3/04; A42B 3/042
USPC ..... 2/422
See application file for complete search history.

(56) References Cited

U.S. PATENT DOCUMENTS 5,307,204 A 4/1994 Dor
5,331,459 A 7/1994 Dor
5,339,464 A 8/1994 Dor
D358,830 S 5/1995 Dor
5,914,816 A 6/1999 Soto et al.
6,457,179 B1 10/2002 Prendergast
6,472,776 B1 10/2002 Soto et al.
6,751,810 B1 6/2004 Prendergast
6,862,748 B2 3/2005 Prendergast
6,938,276 B1 9/2005 Prendergast
6,957,449 B2 10/2005 Prendergast
6,986,162 B2 1/2006 Soto et al.
7,418,738 B2 9/2008 Prendergast
7,444,683 B2 11/2008 Prendergast et al.
7,504,918 B2 3/2009 Prendergast et al.
7,649,701 B2 1/2010 Prendergast et al.
7,735,159 B2 6/2010 Prendergast
7,996,917 B2 8/2011 Prendergast
8,238,045 B2 8/2012 Prendergast et al.
8,239,971 B2 8/2012 Prendergast
8,337,036 B2 12/2012 Soto et al.
2011/0145981 A1* 6/2011 Teetzel ..... A42B 3/04 2/422

* cited by examiner

*Primary Examiner* — Katherine Moran
(74) *Attorney, Agent, or Firm* — Hayes Soloway P.C.

(57) ABSTRACT

An optical device mounting adapter, and system and method for mounting an optical device to a head-worn article are provided. The optical device mounting adapter includes a helmet mount connector. A first arm having a first end is affixed to the helmet mount connector, wherein a second end of the first arm extends away from the helmet mount connector. A second arm is movably attached at a first point to the second end of the first arm, wherein the second arm has an elongated slot formed therein. A mobile support is connected to the second arm, the mobile support having a pin at least partially positioned within the elongated slot, wherein the mobile support is movable along a length of the elongated slot. An optical device connector is affixed to the mobile support.

20 Claims, 7 Drawing Sheets

OPTICAL DEVICE MOUNTING ADAPTER

CROSS REFERENCE TO RELATED APPLICATION

This application claims benefit of U.S. Provisional Application Ser. No. 61/768,759 entitled, "Optical Device Mounting Adapter" filed Feb. 25, 2013, the entire disclosure of which is incorporated herein by reference.

FIELD OF THE DISCLOSURE

The present disclosure is generally related to mounting devices and more particularly is related to an optical device mounting adapter.

BACKGROUND OF THE DISCLOSURE

Optical devices are commonly used in various environments to enhance the capabilities of the user's vision. In military environments, various optical devices are used to give a soldier enhanced visibility in harsh conditions. For example, devices like the PVS 14 night vision monocular are commonly used in the military to enhance a soldier's visibility in low light conditions. These optical devices are affixed to combat helmets, weapons, or other structures that a soldier uses, and during a field operation, a soldier may move the optical device between the various mounting structures.

During operational use of the optical device, it may be necessary for the user to move the optical device between various positions, namely from a position for viewing with the left eye to a position for viewing with the right eye. Conventional mounting device allow some repositioning of the optical device, but to do so, the user must take apart portions of the mounting hardware and then reassemble the mounting hardware in the different configuration. When repositioning of the optical device is urgently required, the time it takes to remove the mounting hardware and reposition may exceed the time available. When conventional mounting hardware is taken apart, the various pieces, including fasteners and clip, may be easily dropped, misplaced, or lost. Furthermore, particulate matter may be prone to contaminating the closely-toleranced connections within the mounting hardware when the connections are exposed, thereby increasing the possibility of failures within the mounting hardware.

Thus, a heretofore unaddressed need exists in the industry to address the aforementioned deficiencies and inadequacies.

SUMMARY OF THE DISCLOSURE

Embodiments of the present disclosure provide an optical device mounting adapter. Briefly described, in architecture, one embodiment of the adapter, among others, can be implemented as follows. An optical device mounting adapter includes a helmet mount connector. A first arm having a first end is affixed to the helmet mount connector, wherein a second end of the first arm extends away from the helmet mount connector. A second arm is movably attached at a first point to the second end of the first arm, the second arm having an elongated slot formed therein. A mobile support is connected to the second arm, the mobile support having a pin at least partially positioned within the elongated slot, wherein the mobile support is movable along a length of the elongated slot. An optical device connector is affixed to the mobile support.

The present disclosure can also be viewed as providing a method of manufacturing an optical device mounting adapter. In this regard, one embodiment of such a method, among others, can be broadly summarized by the following steps: affixing a first arm having a first end to a helmet mount connector, wherein a second end of the first arm extends away from the helmet mount connector; movably attaching a second arm to the first arm, wherein a first point of the second arm is attached to the second end of the first arm; forming an elongated slot within the second arm; connecting a mobile support to the second arm, wherein the mobile support has a pin at least partially positioned within the elongated slot, wherein the mobile support is movable along a length of the elongated slot; and affixing an optical device connector to the mobile support.

The present disclosure can also be viewed as providing a system for mounting an optical device to a head-worn article. Briefly described, in architecture, one embodiment of the system, among others, can be implemented as follows. A shroud is connected to a head-worn article. A helmet mount is engagable with the shroud. A helmet mount connector is engagable with the helmet mount. A first arm having a first end is affixed to the helmet mount connector, wherein a second end of the first arm extends away from the helmet mount connector. A second arm is movably attached at a first point to the second end of the first arm, the second arm having an elongated slot formed therein. A mobile support is connected to the second arm, the mobile support having a pin at least partially positioned within the elongated slot, wherein the mobile support is movable along a length of the elongated slot. An optical device connector is affixed to the mobile support. An optical device is mountable to the optical device connector.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
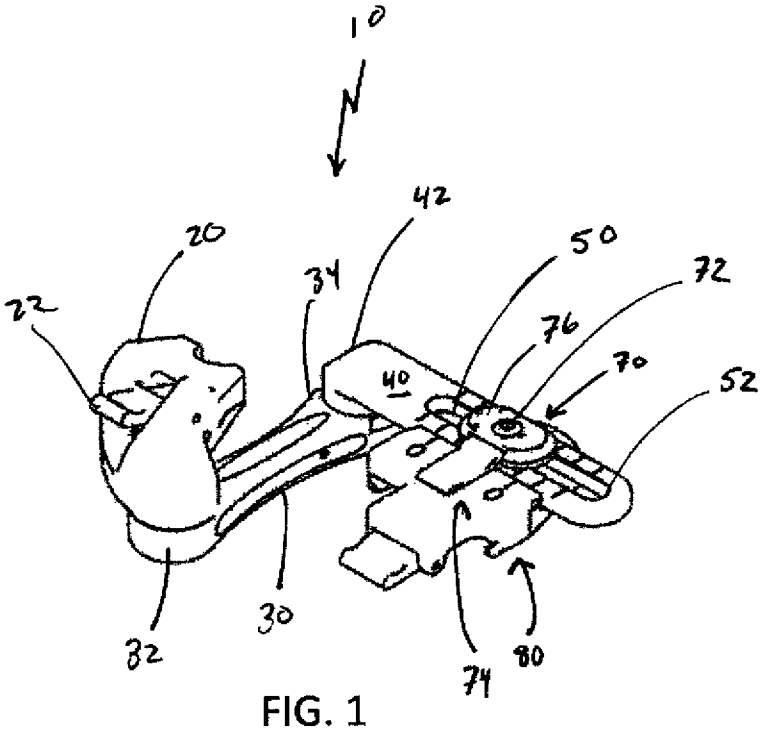
FIG. 1 is a plan view illustration of an optical device mounting adapter, in accordance with a first exemplary embodiment of the present disclosure.

FIG. 1 is a plan view illustration of an optical device mounting adapter 10, in accordance with a first exemplary embodiment of the present disclosure. The optical device mounting adapter 10, which may be referred to herein as 'adapter 10' includes a helmet mount connector 20. A first arm 30 has a first end 32 affixed to the helmet mount connector 20, wherein a second end 34 of the first arm 30 extends away from the helmet mount connector 20. A second arm 40 is movably attached at a first point 42 to the second end 34 of the first arm 30. The second arm 40 has an elongated slot 50 formed therein. A mobile support 70 is connected to the second arm 40. The mobile support 70 has pin 72 at least partially positioned within the elongated slot 50, wherein the mobile support 70 is movable along a length of the elongated slot 50. An optical device connector 80 is affixed to the mobile support 70.

Figure 2:
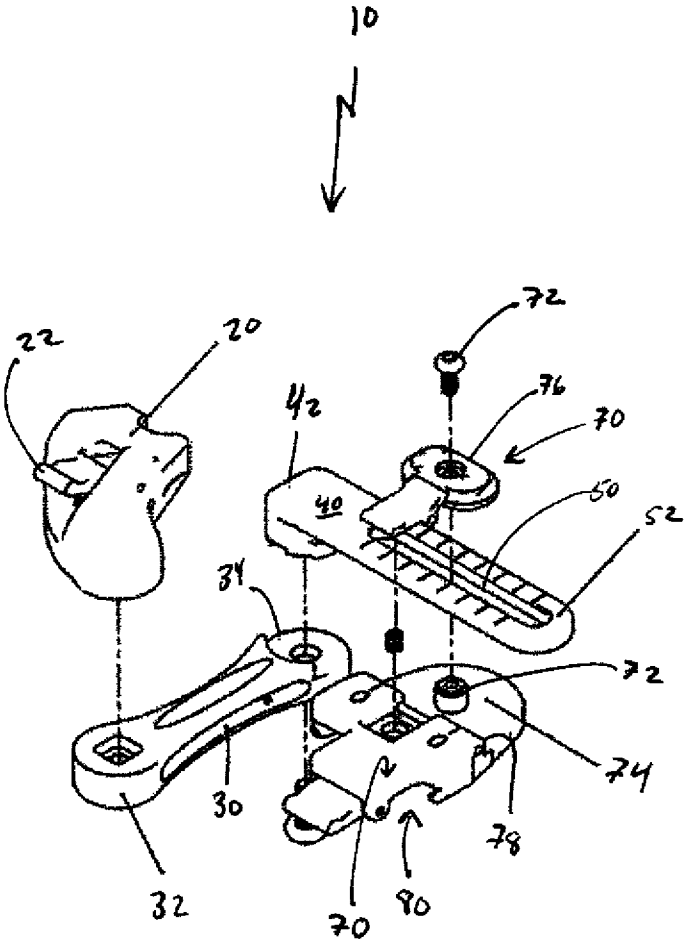
FIG. 2 is an exploded plan view illustration of the optical device mounting adapter, in accordance with the first exemplary embodiment of the present disclosure.
Figure 4:
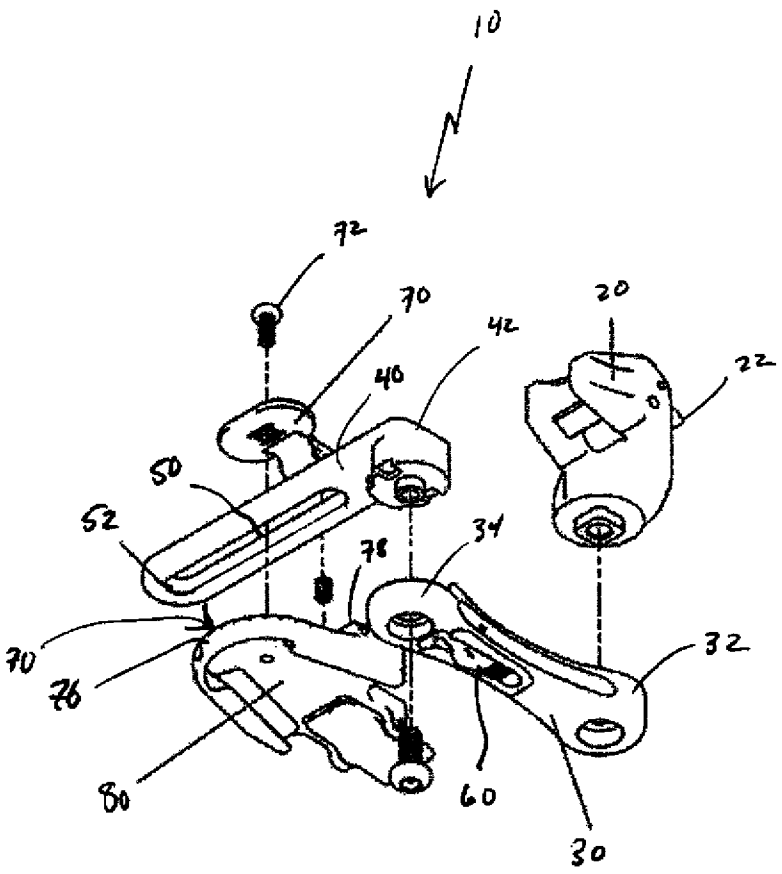
FIG. 4 is an exploded plan view illustration of the underside of the optical device mounting adapter, in accordance with the first exemplary embodiment of the present disclosure.
Figure 3:
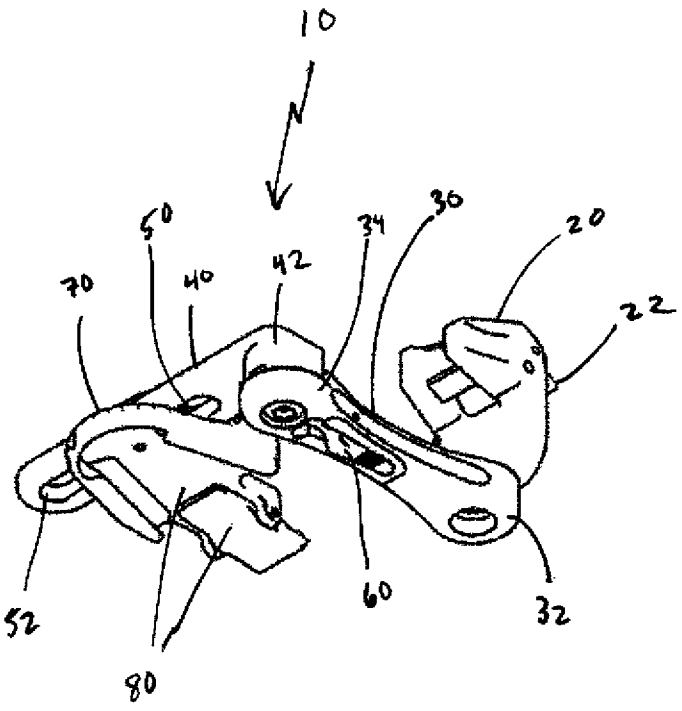
FIG. 3 is a plan view illustration of the underside of the optical device mounting adapter, in accordance with the first exemplary embodiment of the present disclosure.

FIG. 2 is an exploded plan view illustration of the optical device mounting adapter 10, in accordance with the first exemplary embodiment of the present disclosure. FIG. 3 is a plan view illustration of the underside of the optical device mounting adapter 10, in accordance with the first exemplary embodiment of the present disclosure. FIG. 4 is an exploded plan view illustration of the underside of the optical device mounting adapter 10, in accordance with the first exemplary embodiment of the present disclosure. The adapter 10 may be used to mount an optical device, such as a night vision monocular to a combat helmet or other headgear, commonly found within military environments. The adapter 10 may offer significant benefits over conventional mounting devices by allowing the user to orient the optical device in a variety of positions without having to disconnect the optical device from the helmet mount. Other benefits of the adapter 10 are disclosed in detail herein.

With reference to FIGS. 1-4, the optical device mounting adapter 10 can be attached to a helmet mount via the helmet mount connector 20. Helmet mounts are mechanical apparatuses which engage with a shroud positioned on the helmet, or otherwise engage with mounting headgear, to support one or more optical devices in front of the user's eyes. The optical device can be retained in a viewing position to the user, such that the user does not have to hold the optical device with his or her hand to see through it. The helmet mount connector 20 may include any device that is capable of connecting to the helmet mount, many of which are well-known in the art. Most commonly, the helmet mount connector 20 is inserted into a receiver and a retractable locking mount 22 engages with the receiver to lock the helmet mount connector 20 therein.

The first arm 30 is connected to the helmet mount connector 20 at a first end 32. The connection joint between the first arm 30 and the helmet mount connector 20 may be a fixed connector or movable connection. The first arm 30 extends away from the first end 32 and terminates at a second end 34. The first arm 30 may have any length, width, or other dimension, which may be selected based on the intended design and use of the adapter 10. The second arm 40 is movable attached to the second end 34 of the first arm 30 at the first point 42 on the second arm 40. The first point 42, for example, may be an end of the second arm 40 or other point along the second arm 40. The movable joint between the first and second arms 30, 40 may commonly be a pivoting or rotatable connection, such that the second arm 40 is rotatable relative to the first arm 30. However, other types of movable connections are envisioned.

The movable joint between the first and second arms 30, 40 may be controlled by a latch 60 (shown in FIGS. 3-4), thereby allowing the second arm 40 to be retained in a static position relative to the first arm 30, or allowing the second arm 40 to move relative to the first arm 30. The latch 60 may be housed within the first arm 30 (as is shown) or the second arm 40. The latch 60 may be pivotal on a fulcrum and may be biased with a spring or similar structure to keep the latch 60 retained in a locked position until a user actuates it. For example, the latch 60 may remain in a locked position preventing the second arm 40 from moving relative to the first arm 30 until a user actuates the latch 60. The latch 60 may then revert to a locked position when the first and second arms 30, 40 achieve a specific relative orientation, such as a 90° orientation.

The latch 60 may control movement of the second arm 40 relative to the first arm 30 between at least two positions, such as two opposing positions. For example, the latch 60 may retain the second arm 40 in a position that is substantially perpendicular to the first arm 30 on one side of the first arm 30, and in a position where the second arm 40 is substantially perpendicular to the first arm 30 on an opposing side of the first arm. The two positions may be substantially opposite of one another. When an optical device is mounted to the adapter 10, the two opposing positions may correspond with an alignment of the optical device with a user's left eye and right eye. Accordingly, the user can utilize the latch 60 to select whether to position the optical device in front of a left eye or a right eye.

The elongated slot 50 is formed within the second arm 40, along any portion of the second arm 40. For example, as is shown in FIGS. 1-2, the elongated slot 50 may be formed within a distal end of the second arm 40, i.e., a portion of the second arm 40 away from the first point 42. The elongated slot 50 may have any dimension and may be formed fully through an entire thickness of the second arm 40, or partially through the second arm 40, such as where the elongated slot 50 is a blind cavity. The mobile support 70 is movably connected to the second arm 50 via the elongated slot 50, such that the movable support 70 can move along the elongated slot 50. The pin 72 within the mobile support 70 is positioned at least partially within the elongated slot 50.

The pin 72 may be capable of moving along the length of the elongated slot 50 and rotate at an end of the elongated slot 50, thereby allowing the mobile support 70 to be positioned on either elongated side of the elongated slot 50 and rotate from one of the elongated sides to the other around and end point 52 of the elongated slot 50. For example, the mobile support 70 may be moved along the parallel, elongated sides of the second arm 40 and around the rounded, terminating end of the second arm 40, as is described further with respect to FIG. 7.

The mobile support 70 may have a variety of components and designs. In the first exemplary embodiment, the mobile support 70 may have a lower platform 74 that is connected to or formed integral with the optical device connector 80. The lower platform 74 may have a substantially straight guiding wall 78 formed therein, which abuts the second arm 40 when the mobile support 70 is connected on the second arm 40. The pin 72 may be connected to the lower platform 74. When the pin 72 is positioned within the elongated slot 50, an upper platform 76 may engage with the lower platform 74 with any number of fasteners, such as threaded screws. For example, the pin 72 may include a first pin portion having a cavity with internal threading and a threaded fastener, wherein the threaded fastener is threadably engagable with the internal threading of the cavity, as is shown best in FIG. 2. When the upper and lower platforms 76, 74 are engaged together around the second arm 40, the mobile support 70 is capable of being moved along the second arm 40 without being disconnected from the second arm 40. The tolerances between the mobile support 70 and the second arm 40 may be selected to allow the mobile support 70 to move when a certain degree of force is applied to it, thereby preventing the mobile support 70 from moving inadvertently.

Figure 6:
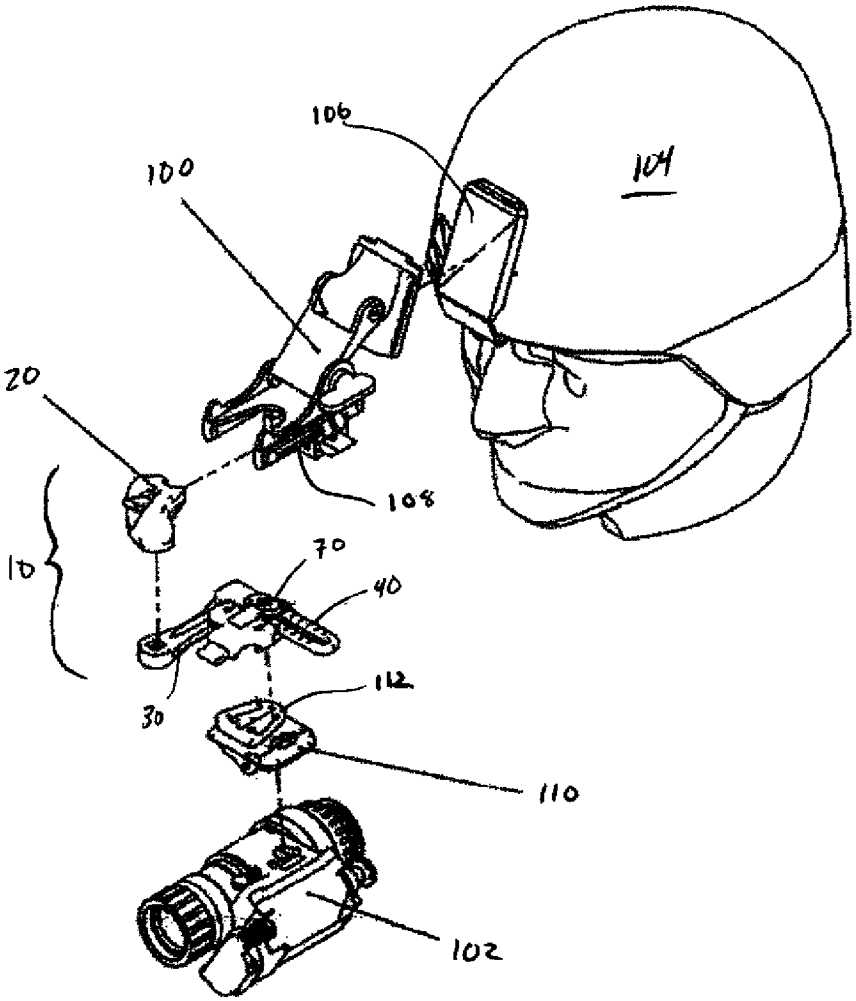
FIG. 6 is an exploded view illustration of the optical device mounting adapter of FIGS. 1-4 in use with a helmet mount, in accordance with the first exemplary embodiment of the present disclosure.
Figure 5:
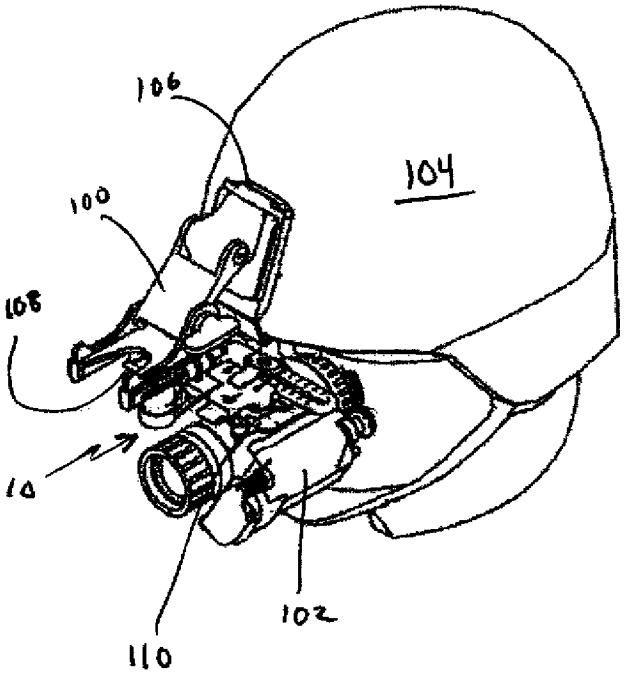
FIG. 5 is a plan view illustration of the optical device mounting adapter of FIGS. 1-4 in use with a helmet mount, in accordance with the first exemplary embodiment of the present disclosure.

FIG. 5 is a plan view illustration of the optical device mounting adapter 10 of FIGS. 1-4 in use with a helmet mount 100, in accordance with the first exemplary embodiment of the present disclosure. FIG. 6 is an exploded view illustration of the optical device mounting adapter 10 of FIGS. 1-4 in use with a helmet mount 100, in accordance with the first exemplary embodiment of the present disclosure. The adapter 10 best utilized to retain an optical device 102 to a head-worn article, such as a helmet 104 or other headgear with various mounting hardware. For example, the mounting hardware may include a shroud 106 affixed to the helmet 104, wherein the helmet mount 100 is connectable to the shroud 106. The helmet mount connector 20 of the adapter 10 may engage with a receiver 108 of the helmet mount 100, and the retractable locking mount 22 within the helmet mount connector 20 can lock the adapter 10 within the receiver 108. A mounting plate 110 having a mounting shoe 112 connected thereto may be used to affix the optical device 102 to the adapter 10. The mounting shoe 112 may be sized to connect to the optical device connector 80, wherein angled sides and an actuatable latch retain the mounting shoe 112 within the optical device connector 80. FIG. 6 shows the optical device 102 in a viewing position relative to a user's eye.

Figure 7:
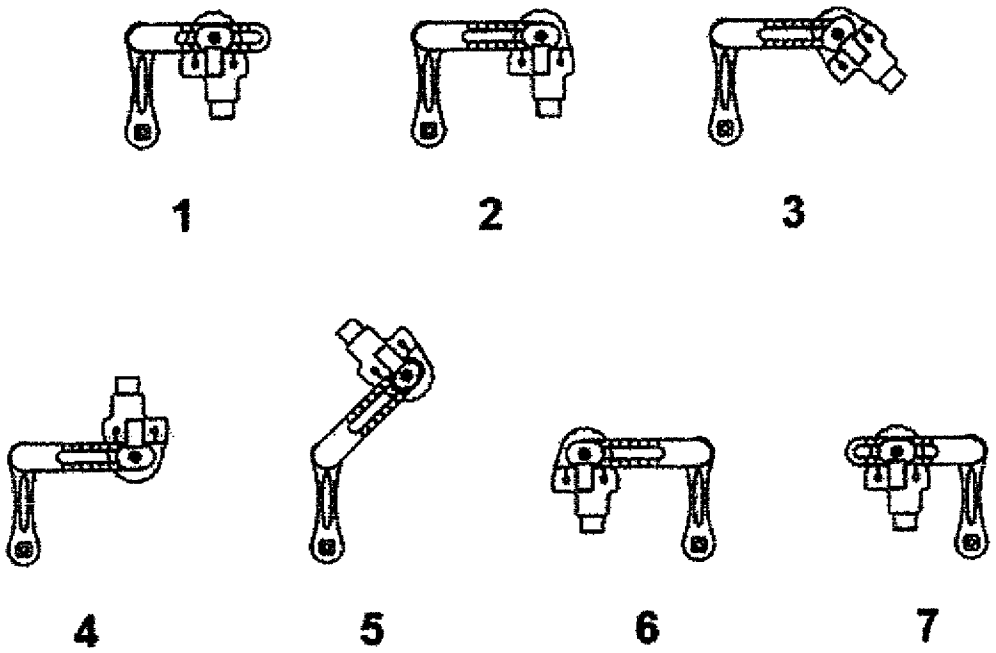
FIG. 7 is a schematic illustration of various positions of the optical device mounting adapter of FIGS. 1-4, in accordance with the first exemplary embodiment of the present disclosure.
Figure 9:
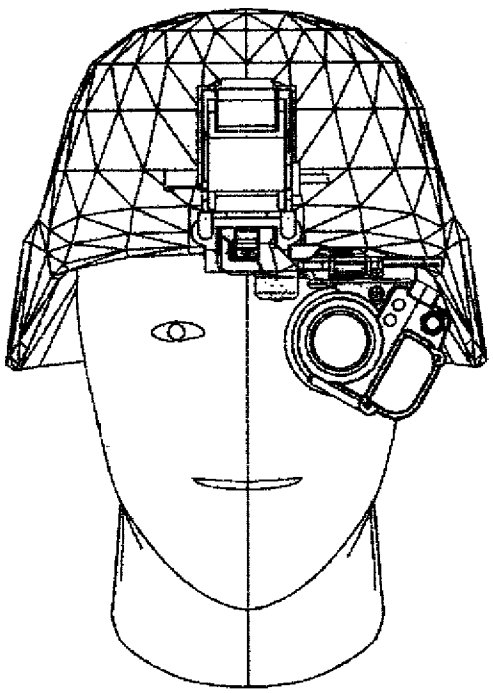
FIGS. 8-9 are front view illustrations of the optical device mounting adapter of FIGS. 1-4 in use with a helmet mount, in accordance with the first exemplary embodiment of the present disclosure.
Figure 8:
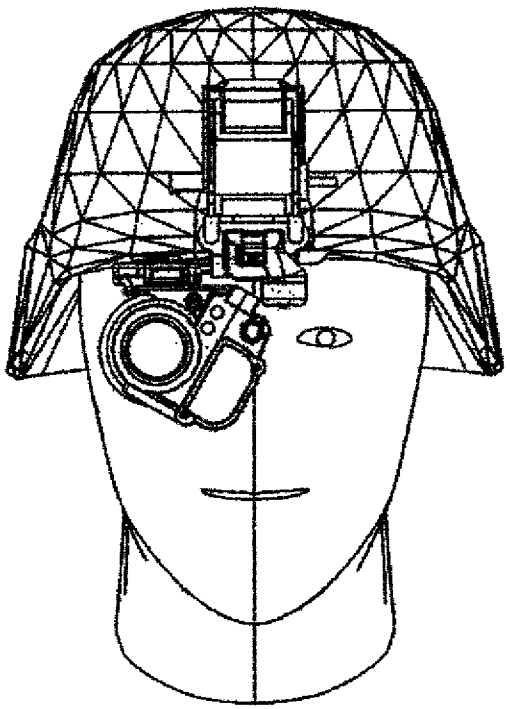

FIG. 7 is a schematic illustration of various positions of the optical device mounting adapter 10 of FIGS. 1-4, in accordance with the first exemplary embodiment of the present disclosure. FIGS. 8-9 are front view illustrations of the optical device mounting adapter 10 of FIGS. 1-4 in use with a helmet mount 100, in accordance with the first exemplary embodiment of the present disclosure. One of the benefits of the adapter 10 is that it allows the user to adjust the positioning of the optical device 102 without having to disconnect the optical device 102 from the helmet mount 100. This ability to move the optical device 102 without having to physically disconnect it from the mounting hardware may allow for efficient use of the optical device 102 in a variety of positions, such as with the left eye or the right eye. Furthermore, this ability may prevent parts of the mounting hardware from being dropped or misplaced, and may also prevent unneeded particle contamination within areas of the mounting hardware.

The adapter 10 may allow for a number of positions for the optical device 102, but the most common positions may be the left eye viewing position shown in FIG. 9 and the right eye viewing position shown in FIG. 8. FIG. 7, depicting the adapter 10 without the helmet mount connector 20, shows the progression of positions to get from the left eye viewing position (step 1) to the right eye viewing position (step 7). From step 1, the mobile support 70 is moved to the end point 52 of the elongated slot 50 (step 2). The mobile support 70 is then rotated around the end point 52 of the elongated slot 50 (step 3) until the mobile support 70 is positioned on the other side of the elongated slot 50 (step 4), i.e. the side opposite the original position of the mobile support 70 in step 1. The latch 60 is actuated and the second arm 40 is rotated relative to the first arm 30 (step 5) until the second arm 40 achieves a predetermined position relative to the first arm 30 (step 6), e.g., a position with a 90° orientation between the first and second arms 30, 40. The mobile support 70 is then moved along the elongated slot 50 to the desired location for proper viewing with the user's right eye (step 7). While not shown within this disclosure, it is noted that the helmet mount 100 may rotate upwards to allow the repositioning of the adapter 10 without contacting a user's head or face. Flip-up helmet mounts 100 are well-known in the art.

Figure 11:
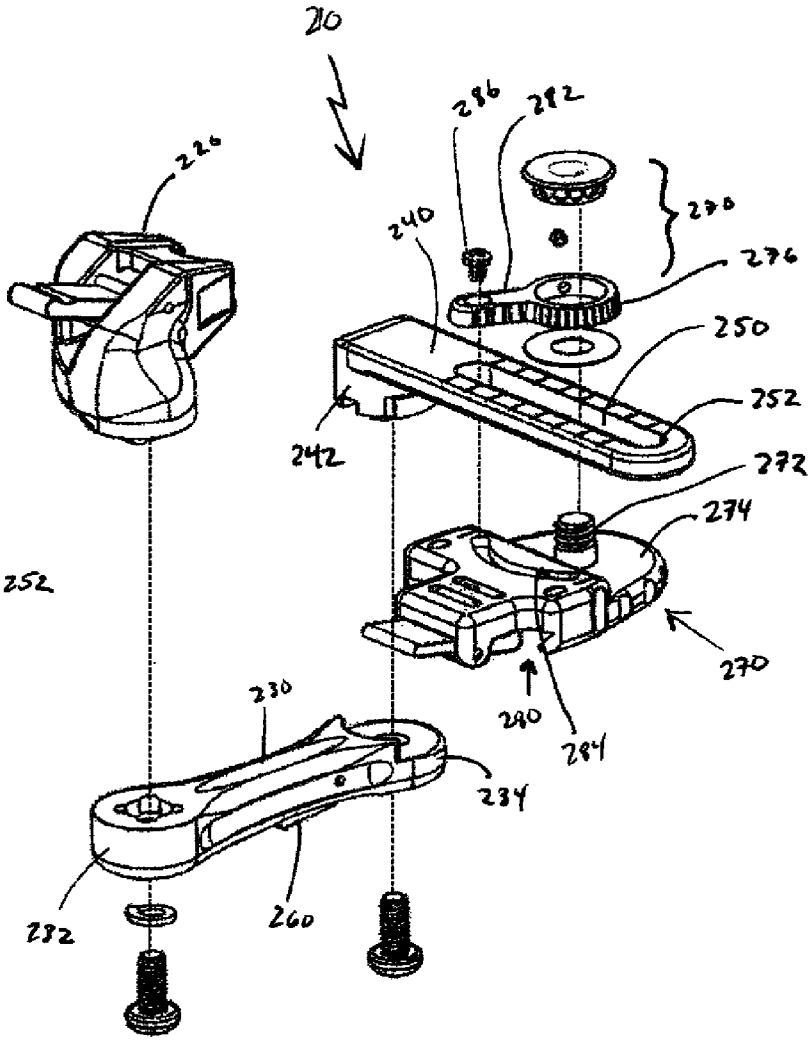
FIG. 11 is an exploded plan view illustration of the optical device mounting adapter, in accordance with the second exemplary embodiment of the present disclosure.
Figure 10:
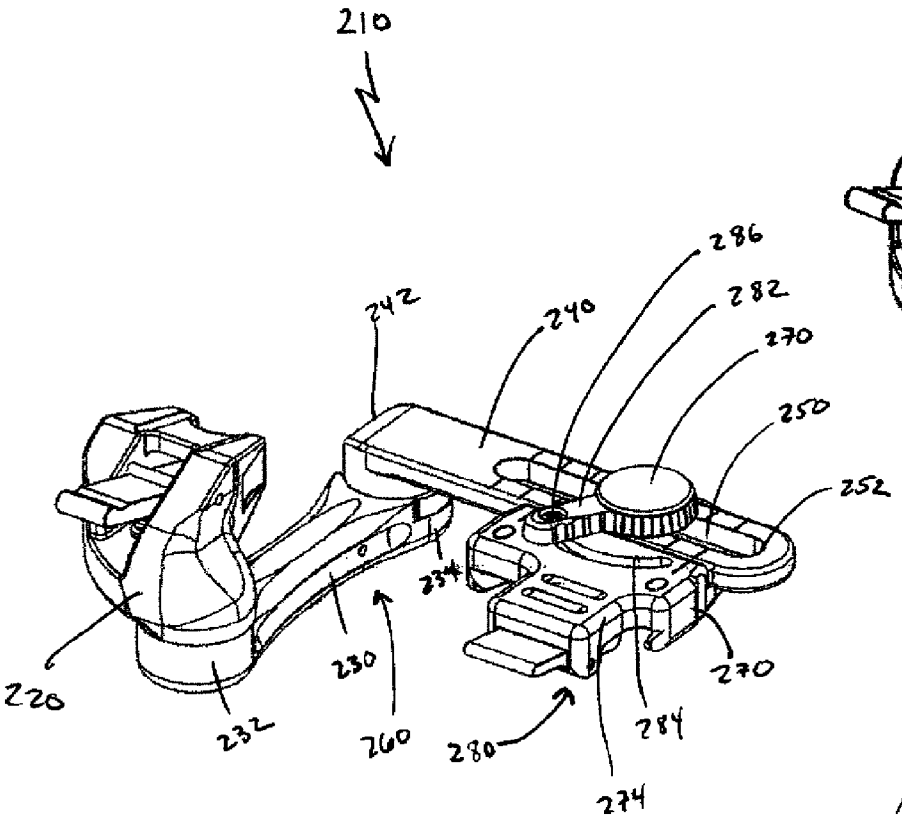
FIG. 10 is a plan view illustration of an optical device mounting adapter, in accordance with a second exemplary embodiment of the present disclosure.

FIG. 10 is a plan view illustration of an optical device mounting adapter 210, in accordance with a second exemplary embodiment of the present disclosure. FIG. 11 is an exploded plan view illustration of the optical device mounting adapter 210, in accordance with the second exemplary embodiment of the present disclosure. The optical device mounting adapter 210, which may be referred to simply as 'adapter 210', may include any of the structures or functions described with respect to the first exemplary embodiment. The adapter 210 includes a helmet mount connector 220. A first arm 230 has a first end 232 affixed to the helmet mount connector 220, wherein a second end 234 of the first arm 230 extends away from the helmet mount connector 220. A second arm 240 is movably attached at a first point 242 to the second end 234 of the first arm 230. The second arm 240 has an elongated slot 250 formed therein. A latch 260 controls movement of the second arm 240 relative to the first arm 230. A mobile support 270 is connected to the second arm 240. The mobile support 270 has pin 272 at least partially positioned within the elongated slot 250, wherein the mobile support 270 is movable along a length of the elongated slot 250. An optical device connector 280 is affixed to the mobile support 270.

The mobile support 270 may differ from the mobile support 70 of FIGS. 1-4 by including a lever 282 with pin 286 connected to the upper platform 276, wherein the pin 286 engages within a curved slot 284 within the lower platform 274. The curved slot 284 is sized to correspond to the length of the lever 282, such that the pin 286 at the end of the lever 282 will snugly move within curved slot 284. These features may help eliminate wobble or other undesirable movements within the mobile support 270 or between the mobile support 270 and other components of the adapter 210 when the mobile support 270 is moved around the end point 252 of the elongated slot 250.

Figure 12:
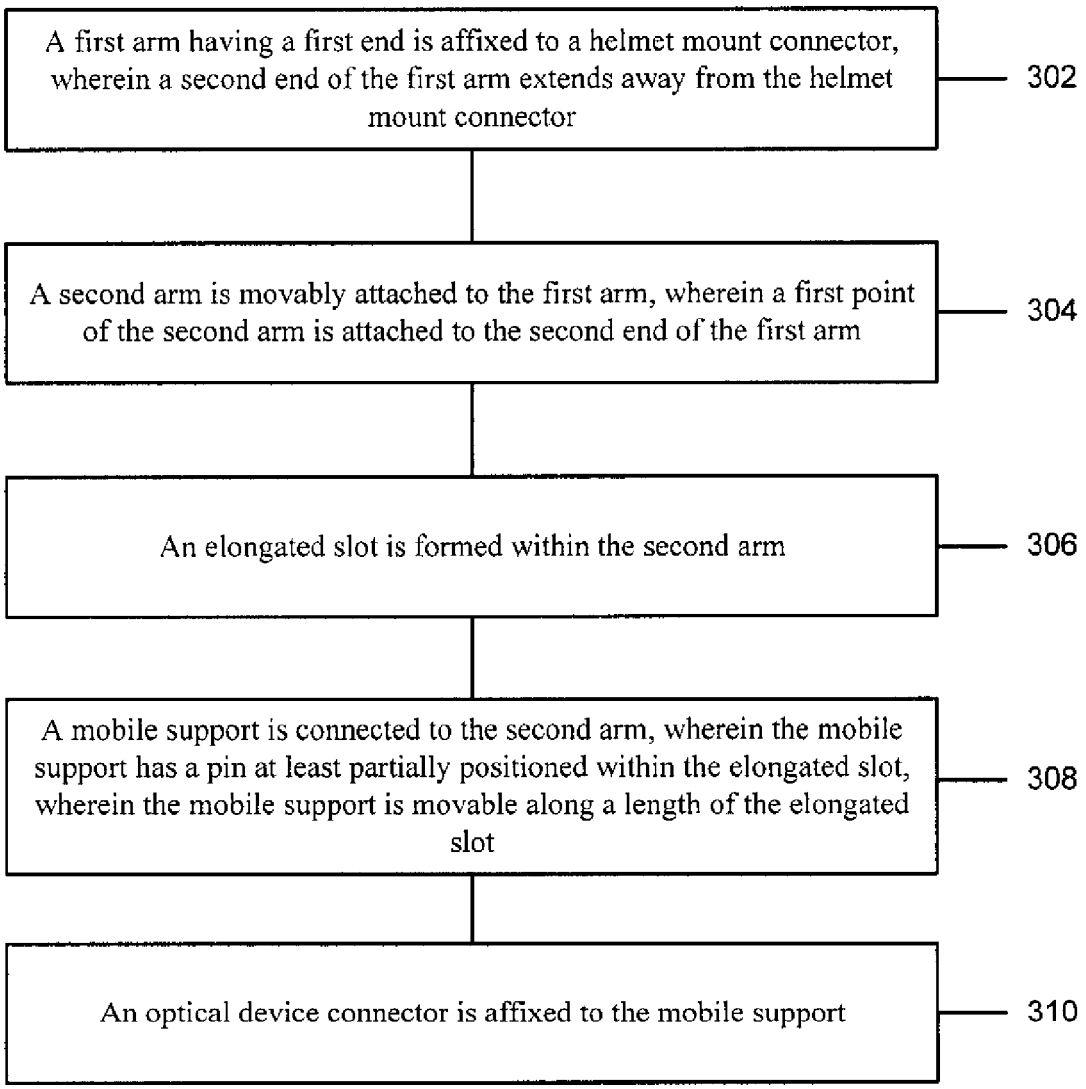
FIG. 12 is a flowchart illustrating a method of manufacturing an optical device mounting adapter, in accordance with the first exemplary embodiment of the disclosure.

FIG. 12 is a flowchart 300 illustrating a method of manufacturing an optical device mounting adapter, in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 302, a first arm having a first end is affixed to a helmet mount connector, wherein a second end of the first arm extends away from the helmet mount connector. A second arm is movably attached to the first arm, wherein a first point of the second arm is attached to the second end of the first arm (block 304). An elongated slot is formed within the second arm (block 306). A mobile support is connected to the second arm, wherein the mobile support has a pin at least partially positioned within the elongated slot, wherein the mobile support is movable along a length of the elongated slot (block 308). An optical device connector is affixed to the mobile support (block 310).

The method may include any additional number of steps, functions, or variations thereof, including any of the functions disclosed relative to FIGS. 1-11. For example, movement of the second arm relative to the first arm may be controlled with a latch, which may include controlling a movement of the second arm relative to the first arm between at least two positions, wherein in a first of the at least two positions, the second arm is positioned substantially perpendicular to the first arm, and wherein in a second of the at least two positions, the second arm is positioned substantially perpendicular to the first arm, wherein the first of the at least two positions is substantially opposite the second of the at least two positions. The movable support may be moveable along at least two parallel sides of the second arm. Connecting the mobile support to the second arm may include connecting together an upper platform to a lower platform with the pin. Additionally, the optical device connector may be formed with at least two angled sides and an actuatable latch, wherein the at least two angled sides are sized to receive a mounting shoe therein, wherein the actuatable latch is sized to retaining the mounting shoe between the at least two angled sides.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An optical device mounting adapter comprising:
a helmet mount connector;
a first arm having a first end affixed to the helmet mount connector, wherein a second end of the first arm extends away from the helmet mount connector;
a second arm having a first end and a second end, wherein the first end of the second arm is pivotally attached to the second end of the first arm, wherein the second arm has an elongated slot formed therein;
a mobile support connected to the second arm, the mobile support having a pin at least partially positioned within the elongated slot, wherein the mobile support is movable along a length of the elongated slot; and
an optical device connector affixed to the mobile support.

2. The optical device mounting adapter of claim 1, further comprising a latch controlling movement of the second arm relative to the first arm.

3. The optical device mounting adapter of claim 2, wherein the latch controls movement of the second arm relative to the first arm between at least two positions, wherein in a first of the at least two positions, the second arm is positioned substantially perpendicular to the first arm, and wherein in a second of the at least two positions, the second arm is positioned substantially perpendicular to the first arm, wherein the first of the at least two positions is substantially opposite the second of the at least two positions.

4. The optical device mounting adapter of claim 1, wherein the elongated slot is formed through an entire thickness of the second arm.

5. The optical device mounting adapter of claim 1, wherein the mobile support is moveable along at least two parallel sides of the second arm.

6. The optical device mounting adapter of claim 1, wherein the mobile support further comprises:
an upper platform; and
a lower platform, wherein the pin is connected between the upper and lower platforms.

7. The optical device mounting adapter of claim 6, wherein the pin further comprises a first pin portion having a cavity with internal threading and a threaded fastener, wherein the threaded fastener is threadably engagable with the internal threading of the cavity.

8. The optical device mounting adapter of claim 6, wherein the optical device connector is formed on an underside of the lower platform.

9. The optical device mounting adapter of claim 6, further comprising a curved slot formed within the lower platform and a lever formed on the upper platform, wherein a second pin connected to the lever is movable within the curved slot of the lower platform.

10. The optical device mounting adapter of claim 6, wherein the lower platform further comprises a guiding wall with a substantially straight edge, wherein an elongated side of the second arm is positionable against the guiding wall.

11. The optical device mounting adapter of claim 1, wherein the second end of the second arm further comprises a rounded, terminating end, wherein the mobile support is movable from a first side of the second arm, around the rounded, terminating end, and to an second side of the second arm, wherein the first and second sides are parallel.

12. The optical device mounting adapter of claim 1, wherein an elongated length of the second arm is angularly adjustable relative to an elongated length of the first arm.

13. A system for mounting an optical device to a head-worn article, the system comprising:
a shroud connected to a head-worn article;
a helmet mount engagable with the shroud;
a helmet mount connector engagable with the helmet mount;
a first arm having a first end affixed to the helmet mount connector, wherein a second end of the first arm extends away from the helmet mount connector;

a second arm having a first end pivotally attached to the second end of the first arm, the second arm having an elongated slot formed therein;

a mobile support connected to the second arm, the mobile support having a pin at least partially positioned within the elongated slot, wherein the mobile support is movable along a length of the elongated slot;

an optical device connector affixed to the mobile support; and an optical device mountable to the optical device connector.

14. The system of claim 13, wherein second arm is movable between at least two positions, wherein in a first of the at least two positions, the second arm is positioned substantially perpendicular to the first arm and the optical device is positioned on a left side of the head-worn article, and wherein in a second of the at least two positions, the second arm is positioned substantially perpendicular to the first arm and the optical device is positioned on a right side of the head-worn article, wherein the first of the at least two positions is substantially opposite the second of the at least two positions and the left side of the head-worn article is substantially opposite the right side of the head-worn article.

15. A method of manufacturing an optical device mounting adapter, the method comprising the steps of:

affixing a first arm having a first end to a helmet mount connector, wherein a second end of the first arm extends away from the helmet mount connector;

pivotally attaching a first end of a second arm to the second end of the first arm, whereby an elongated length of the second arm is angularly adjustable relative to an elongated length of the first arm;

forming an elongated slot within the second arm;

connecting a mobile support to the second arm, wherein the mobile support has a pin at least partially positioned within the elongated slot, wherein the mobile support is movable along a length of the elongated slot; and affixing an optical device connector to the mobile support.

16. The method of claim 15, further comprising the step of controlling movement of the second arm relative to the first arm with a latch movably connected to the first arm, whereby actuating the latch between locked and unlocked positions engages and disengages the latch with the second arm.

17. The method of claim 16, wherein controlling movement of the second arm relative to the first arm with the latch further comprises controlling a movement of the second arm relative to the first arm between at least two positions, wherein in a first of the at least two positions, the second arm is positioned substantially perpendicular to the first arm, and wherein in a second of the at least two positions, the second arm is positioned substantially perpendicular to the first arm, wherein the first of the at least two positions is substantially opposite the second of the at least two positions.

18. The method of claim 15, wherein the mobile support is moveable along at least two parallel sides of the second arm and around a terminating end of the second arm.

19. The method of claim 15, wherein connecting the mobile support to the second arm further comprises connecting together an upper platform to a lower platform with the pin.

20. The method of claim 15, further comprising the step of forming the optical device connector with at least two angled sides and an actuatable latch, wherein the at least two angled sides are sized to receive a mounting shoe therein, wherein the actuatable latch is sized to retaining the mounting shoe between the at least two angled sides.

* * * * *